US009804544B2

(12) United States Patent
Takagi

(10) Patent No.: US 9,804,544 B2
(45) Date of Patent: Oct. 31, 2017

(54) FIXING DEVICE AND IMAGE FORMING APPARATUS

(71) Applicant: TOSHIBA TEC KABUSHIKI KAISHA, Tokyo (JP)

(72) Inventor: Osamu Takagi, Chofu Tokyo (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/861,082

(22) Filed: Sep. 22, 2015

(65) Prior Publication Data

US 2016/0085187 A1 Mar. 24, 2016

(30) Foreign Application Priority Data

Sep. 24, 2014 (JP) ..... 2014-193461

(51) Int. Cl.
*G03G 15/20* (2006.01)

(52) U.S. Cl.
CPC ..... *G03G 15/2053* (2013.01); *G03G 15/2042* (2013.01); *G03G 2215/2032* (2013.01)

(58) Field of Classification Search
CPC . G03G 15/20; G03G 15/2039; G03G 15/2053
USPC ..... 399/38, 67–69, 107, 110, 122, 320, 328, 399/329; 219/216, 619
See application file for complete search history.

(56) References Cited

U.S. PATENT DOCUMENTS

| | | | | |
|---|---|---|---|---|
| 6,900,419 | B2 * | 5/2005 | Takagi | G03G 15/2064 219/619 |
| 8,592,726 | B2 * | 11/2013 | Tsuruya | G03G 15/2042 219/216 |
| 9,098,034 | B2 * | 8/2015 | Shimura | G03G 15/2053 |
| 9,244,411 | B2 * | 1/2016 | Seshita | G03G 15/2064 |

FOREIGN PATENT DOCUMENTS

| | | | |
|---|---|---|---|
| EP | 2711778 | A2 | 3/2014 |
| JP | 2629980 | B2 | 7/1997 |
| JP | 2007025474 | A | 2/2007 |
| JP | 2010054846 | A | 3/2010 |
| JP | 2012252190 | A | 12/2012 |

OTHER PUBLICATIONS

Extended European Search Report dated Feb. 2, 2016, mailed in counterpart European Application No. 15185089.8, 8 pages.

* cited by examiner

*Primary Examiner* — Hoan Tran
(74) *Attorney, Agent, or Firm* — Patterson & Sheridan, LLP

(57) ABSTRACT

A fixing device includes a roller, an endless belt, and a heat generating member disposed in a space inside the endless belt, extending in a width direction of the endless belt, and pressing the endless belt against the roller. A sheet is passed through a nip formed between the roller and a portion of the endless belt pressed by the heat generating member, such that an image on the sheet is fixed thereto. The heat generating member includes first and second heat generating portions that are adjacent to each other along the width direction and independently operable from each other. A boundary of the first and second heat generating portions extends in a direction inclined with respect to a sheet conveying direction.

20 Claims, 6 Drawing Sheets

FIXING DEVICE AND IMAGE FORMING APPARATUS

CROSS-REFERENCE TO RELATED APPLICATION

This application is based upon and claims the benefit of priority from Japanese Patent Application No. 2014-193461, filed Sep. 24, 2014, the entire contents of which are incorporated herein by reference.

FIELD

Embodiments described herein relate generally to a fixing device and an image forming apparatus.

BACKGROUND

A fixing device mounted on an image forming apparatus typically employs a lamp that emits infrared rays, such as a halogen lamp, or an induction heating unit that generates heat by electromagnetic induction as a heat source for fixing an image to an imaging medium.

In general, the fixing device includes a pair of heating rollers (or a fixing belt stretched around a plurality of rollers) and a press roller. In such a fixing device, it is preferable that heat capacity of elements of the fixing device be reduced as much as possible, and that only a region that contributes to fixing the image is heated, so that thermal efficiency of the fixing device is maximized.

DETAILED DESCRIPTION

Figure 1:
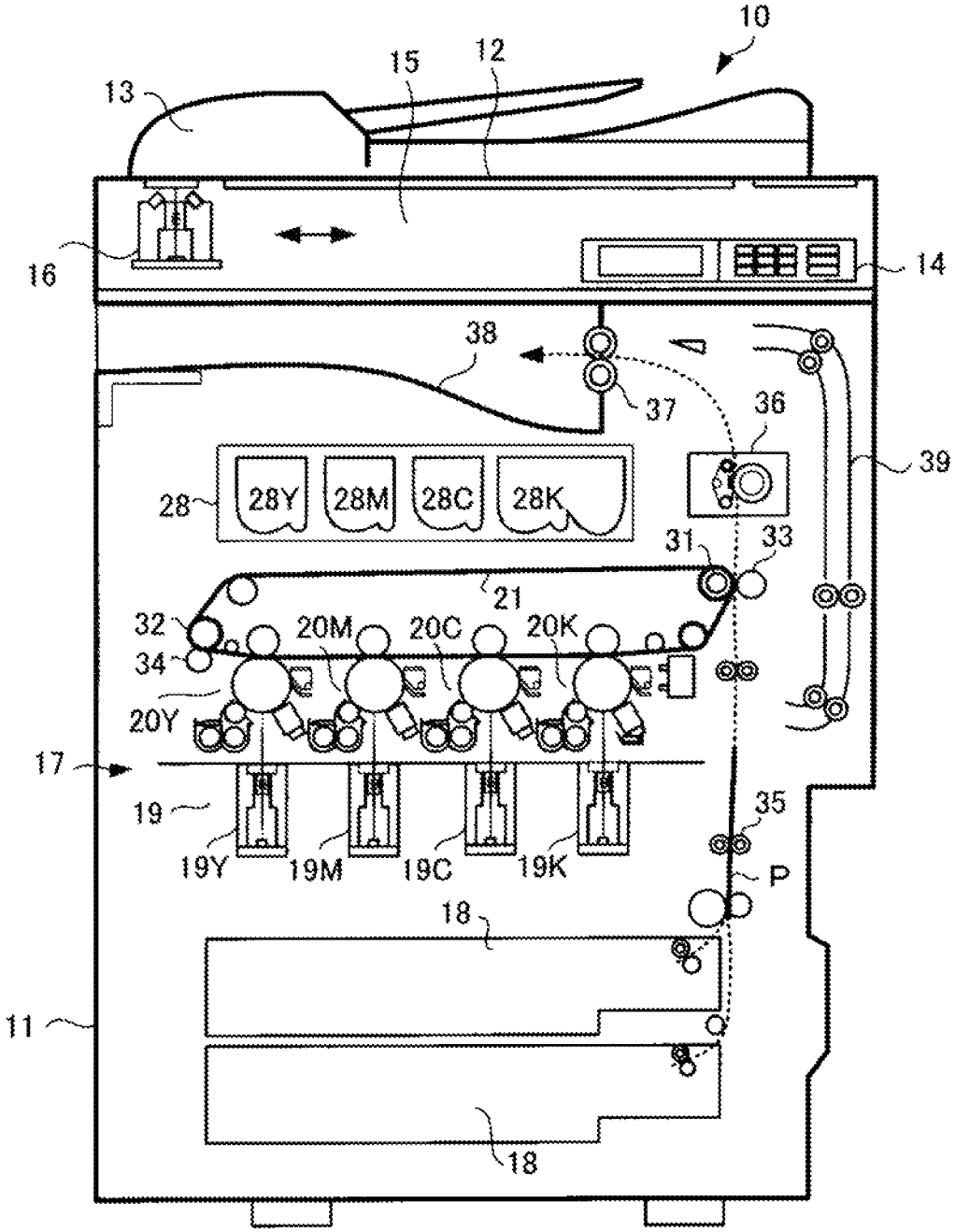
FIG. 1 illustrates a configuration of an image forming apparatus on which a fixing device according to an embodiment is mounted.

In an image forming apparatus using a thermal fixing processing, it is difficult to heat only a device region (i.e., a nip portion) used to fix an image because heat energy diffuses. Thus, it is difficult to optimize overall thermal efficiency. Furthermore, in the fixing device for electrophotography, when heating is uneven in a direction perpendicular to a sheet transport direction, it reduces fixing quality. Particularly, in a case of color printing, differences in color and glossiness may occur due to variation in heating across the image being fixed.

Furthermore, in the fixing device in which the heat capacity of the fixing elements is very low, temperature of the portions of the device through which a sheet does not pass will be significantly increased, which may result in a problem such as speed irregularity due to warpage of elements, deterioration of belts, expansion of a transport roller, and the like may occur. Furthermore, heating of device elements not directly used in the image fixing process is not preferable from the viewpoint of energy saving.

An embodiment is directed towards stably heating a sheet passing region and reducing energy consumption without compromising fixing quality.

In general, according to an embodiment, a fixing device includes a roller, an endless belt, and a heat generating member disposed in a space inside the endless belt, extending in a width direction of the endless belt, and pressing the endless belt against the roller. A sheet is passed through a nip formed between the roller and a portion of the endless belt pressed by the heat generating member, such that an image on the sheet is fixed thereto. The heat generating member includes first and second heat generating portions with a boundary between these portions that has at least a portion that is not aligned with (e.g., inclined with respect to) a sheet conveyance direction. The first and second heat generating portions are spaced from each other in the width direction and independently operable from each other with the boundary therebetween.

In another embodiment, a fixing device includes: a determination section that determines a size of a medium (e.g., a sheet of paper) on which a toner image has been or can be formed; a heating section that heats the medium and includes a rotating body having an endless shape (e.g. a belt), a plurality of heat generating members which have a same length in a transport direction of the medium, are divided into a plurality of different lengths in a direction perpendicular to the transport direction (e.g., width direction), of which a creepage (separation) distance between electrodes formed at both ends and a creepage distance or a space distance of a boundary portion between heat generating members after they divided is adjusted to be a predetermined value. The heat generating members are provided in contact with an inside of the rotating body. A switching unit that individually switches electric conduction of electrodes of each of the heat generating members. A pressing section (e.g., roller) forms a nip by coming into pressed contact with the heating section at positions corresponding to the plurality of heat generating members, and transports the medium in the transport direction by pinching the medium together with the heating section. A heating control section selects a heat generating member or members from among the plurality of heat generating members that corresponds in a position at which the medium passes through the nip by operation of the switching unit(s), or otherwise controls heating in the heating section such that the selected heat generating member(s) correspond to the size (width) of the medium being passed through the nip.

Hereinafter, a fixing device according to an embodiment will be described with reference to the drawings. FIG. 1 illustrates a configuration an image forming apparatus on which the fixing device according to the present embodiment is mounted. In FIG. 1, for example, an image forming apparatus 10 is a Multi-Function Peripherals (MFP), a printer, a copying machine, and the like. In the following description, the MFP is described as an example.

A document table 12 of transparent glass is provided on an upper portion of a body 11 of the MFP 10 and an automatic document transport unit (ADF) 13 is provided on the document table 12, such that the ADF 13 is openable and closable. Furthermore, an operation unit 14 is provided on an upper portion of the body 11. The operation unit 14 has various keys and a touch panel type display unit.

A scanner unit 15, which is a reading device, is provided in a lower portion of the ADF 13 within the body 11. The scanner unit 15 is provided to generate image data by reading a document sent by the ADF 13 or a document placed on the document table and includes a contact type image sensor 16 (hereinafter, simply referred to as image sensor). The image sensor 16 is arranged in a main scanning direction (depth direction in FIG.

The image sensor 16 reads a document image line by line while moving along the document table 12 when reading the image of the document mounted on the document table 12. This process is performed of the entire region of the document to read the document of one page. Furthermore, the image sensor 16 is at a fixed position (position illustrated in FIG. 1) when reading the image of the document is sent by the ADF 13.

Furthermore, a printer unit 17 is provided in a center portion of the body 11 and a plurality of sheet feeding cassettes 18 for storing sheets P of various sizes is provided in the lower portion of the body 11.

The printer unit 17 processes image data read by the scanner unit 15 or image data created by a personal computer and the like to form a corresponding image on the sheet. For example, the printer unit 17 is a color laser printer of a tandem type and includes image forming units 20Y, 20M, 20C, and 20K of each color of yellow (Y), magenta (M), cyan (C), and black (K). The image forming units 20Y, 20M, 20C, and 20K are arranged in parallel below an intermediate transfer belt 21, in order, from an upstream side to a downstream side along a rotational direction of the intermediate transfer belt 21. Furthermore, a laser exposure device (scanning head) 19 also includes a plurality of laser exposure devices 19Y, 19M, 19C, and 19K corresponding to the image forming units 20Y, 20M, 20C, and 20K, respectively.

Figure 2:
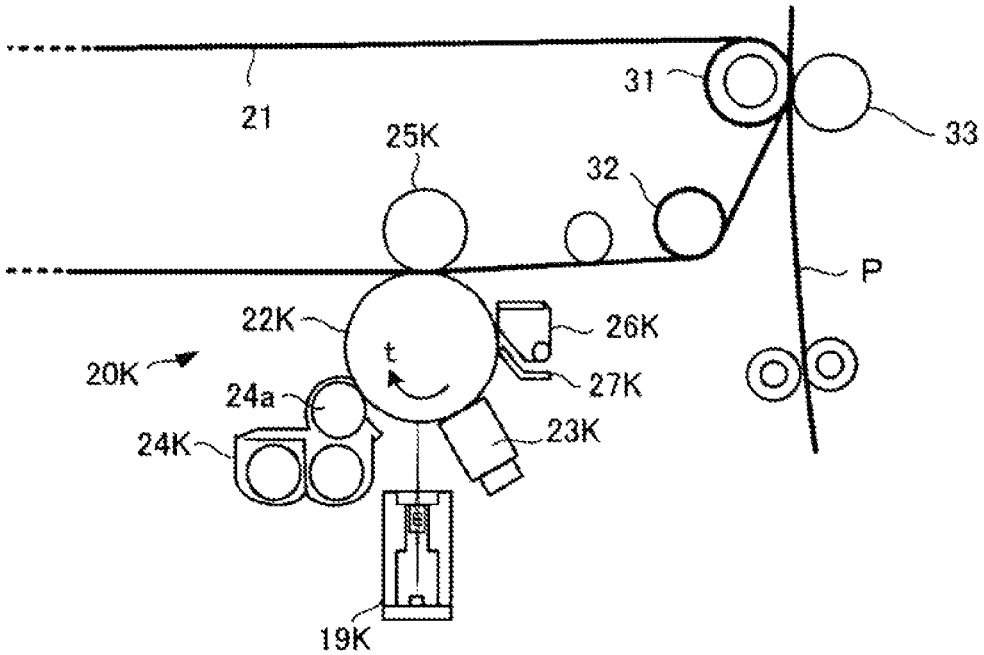
FIG. 2 illustrates an enlarged portion of an image forming unit of the image forming apparatus.

FIG. 2 illustrates the image forming unit 20K in an enlarged manner. In the following description, since the image forming units 20Y, 20M, 20C, and 20K respectively have the same configuration, the image forming unit 20K is described as an example.

The image forming unit 20K includes a photosensitive drum 22K, which is an image carrier. A charger (electric charger) 23K, a developer 24K, a primary transfer roller (transfer device) 25K, a cleaner 26K, a blade 27K, and the like are arranged around the photosensitive drum 22K in a rotational direction t. Light from the laser exposure device 19K is applied to an exposure position of the photosensitive drum 22K, and an electrostatic latent image is formed on the photosensitive drum 22K.

The charger 23K of the image forming unit 20K uniformly charges a surface of the photosensitive drum 22K. The developer 24K supplies two-component developer containing black toner and carrier to the photosensitive drum 22K by a developing roller 24a to which developing bias is applied, and performs developing of the electrostatic latent image. The cleaner 26K removes residual toner on the surface of the photosensitive drum 22K using the blade 27K.

Furthermore, as illustrated in FIG. 1, a toner cartridge 28 for supplying toner to one of the developers 24Y to 24K is provided in an upper portion each of the image forming units 20Y to 20K. The toner cartridge 28 includes toner cartridges of one of colors of yellow (Y), magenta (M), cyan (C), and black (K).

The intermediate transfer belt 21 cyclically moves. The intermediate transfer belt 21 is stretched around a driving roller 31 and a driven roller 32. Furthermore, the intermediate transfer belt 21 faces and comes into contact with photosensitive drums 22Y to 22K. A primary transfer voltage is applied to a position of the intermediate transfer belt 21 facing the photosensitive drum 22K by the primary transfer roller 25K, and the toner image on the photosensitive drum 22K is primarily transferred onto the intermediate transfer belt 21.

The driving roller 31 around which the intermediate transfer belt 21 is stretched is arranged to face a secondary transfer roller 33. When the sheet P passes between the driving roller 31 and the secondary transfer roller 33, a secondary transfer voltage is applied by the secondary transfer roller 33. Then, the toner image on the intermediate transfer belt 21 is secondarily transferred onto the sheet P. A belt cleaner 34 is provided in the vicinity of the driven roller 32 of the intermediate transfer belt 21.

Furthermore, as illustrated in FIG. 1, a sheet feeding roller 35 that transports the sheet P taken out from the sheet feeding cassette 18 is provided between the sheet feeding cassette 18 and the secondary transfer roller 33. Furthermore, a fixing device 36 is provided on a downstream of the secondary transfer roller 33 in a sheet conveying direction. Furthermore, a transport roller 37 is provided on a downstream of the fixing device 36 in a sheet conveying direction. The transport roller 37 discharges the sheet P to a sheet discharging unit 38. Furthermore, a reverse transport path 39 is provided on the downstream of the fixing device 36 in a sheet conveying direction. The reverse transport path 39 guides the sheet P towards the secondary transfer roller 33 by reversing the sheet P and is used when performing duplex printing. FIGS. 1 and 2 illustrate the configuration example of the MFP 10 and do not limit a structure of a portion of the image forming apparatus other than the fixing device 36. It is possible to use a known structure of an electrophotographic image forming apparatus.

Figure 3:
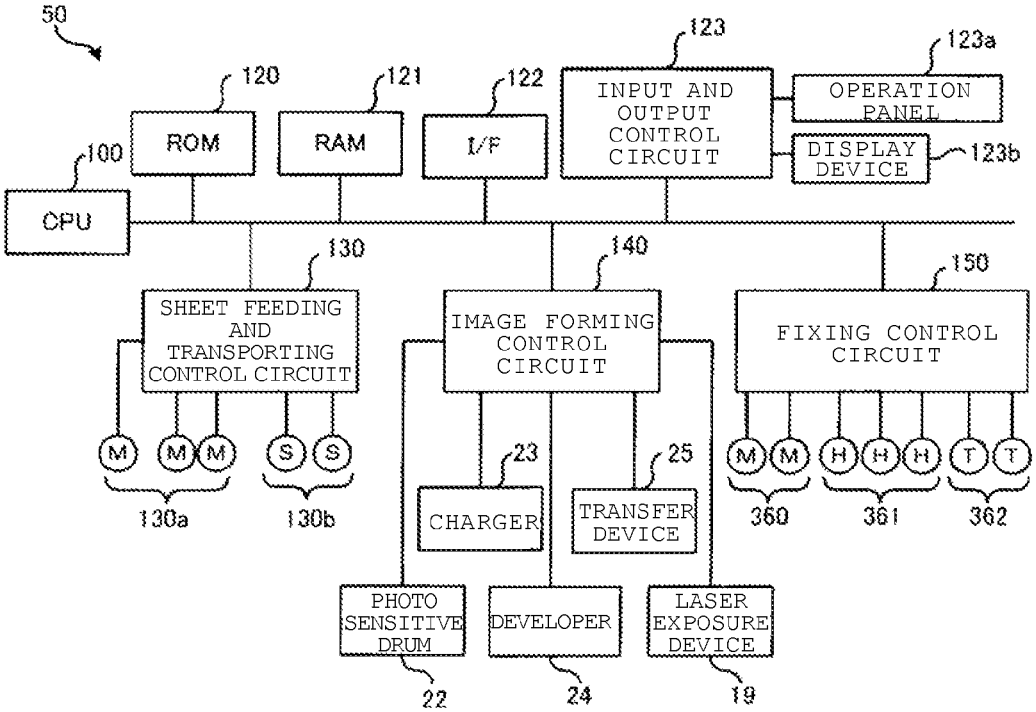
FIG. 3 is a block diagram of a control system of the image forming apparatus.

FIG. 3 is a block diagram of a control system 50 of the MFP 10 according to the present embodiment. For example, the control system 50 includes a CPU 100 for controlling an entirety of the MFP 10, a read only memory (ROM) 120, a random access memory (RAM) 121, an interface (I/F) 122, an input and output control circuit 123, a sheet feeding and transporting control circuit 130, an image forming control circuit 140, and a fixing control circuit 150.

The CPU 100 performs a processing function for forming the image by executing a program stored in the ROM 120 or the RAM 121. The ROM 120 stores a control program, control data, and the like to perform a basic operation of the image forming. The RAM 121 is a working memory. For example, the ROM 120 (or the RAM 121) stores control programs of the image forming unit 20, the fixing device 36, and the like, and various control data which are used to execute the control programs. In the present embodiment, the control data includes, for example, a correspondence relationship between a sheet passing region of the sheet, a size (width in the main scanning direction) of a printing region in the sheet, and a heat generating member that is electrically conducted.

A fixing temperature control program of the fixing device 36 includes a determination logic to determine the size of an image forming region in the sheet on which a toner image is formed and a heating control logic to select and electrically conduct a switching element of the heat generating member corresponding to the sheet passing region of the sheet before the sheet is transported to the fixing device 36 and control heating in the heating section.

The I/F 122 performs communication with various devices such as a user terminal and a facsimile. The input and output control circuit 123 controls an operation panel 123*a* and a display device 123*b* of the operation unit 14. The sheet feeding and transporting control circuit 130 controls a motor group 130*a* and the like that drives the sheet feeding roller 35, the transport roller 37 of the transport path, and the like. The sheet feeding and transporting control circuit 130 controls the motor group 130*a* and the like based on a detection result of various sensors 130*b* disposed in the vicinity of the sheet feeding cassette 18 or on the transport path, in accordance with a control signal from the CPU 100. The image forming control circuit 140 controls the photosensitive drum 22, the charger 23, the laser exposure device 19, the developer 24, and the transfer device 25 in accordance with a control signal from the CPU 100, respectively. The fixing control circuit 150 controls a driving motor 360, a heating member 361, a temperature detecting member 362 such as thermistor of the fixing device 36 in accordance with the control signal from the CPU 100, respectively. Furthermore, in the present embodiment, the control program and control data of the fixing device 36 are stored in a storage device of the MFP 10 and executed by the CPU 100, but a calculation processing device and a storage device dedicated for the fixing device 36 may be separately provided.

Figure 4:
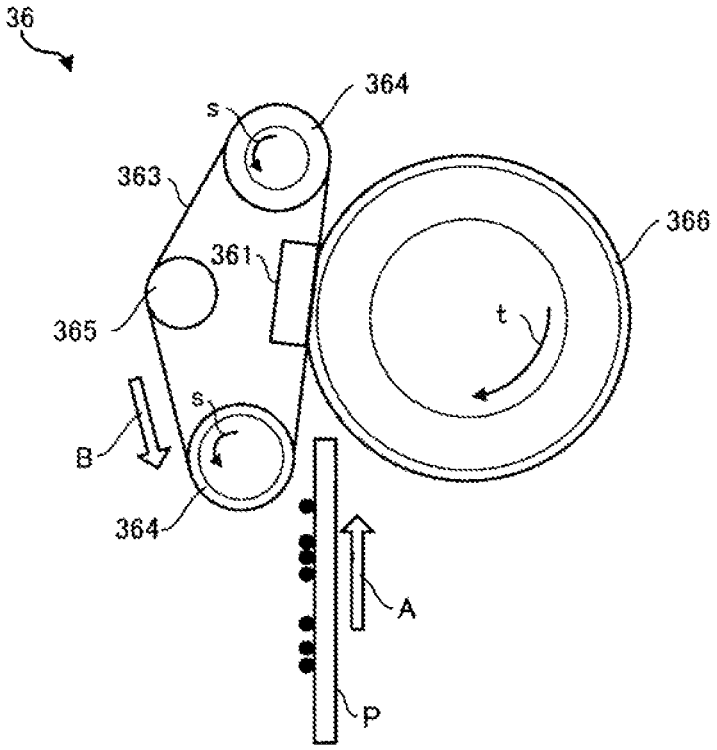
FIG. 4 illustrates a configuration of the fixing device according to the embodiment.

FIG. 4 illustrates a configuration example of the fixing device 36. Here, the fixing device 36 includes the plate-shaped heating member 361, an endless (continuous) belt 363 on which an elastic layer is formed and which is wound around a plurality of rollers, a belt transporting roller 364 that drives the endless belt 363, a tension roller 365 to extend the endless belt 363, and a press roller 366 where an elastic layer is formed on a surface thereof. A side of the heating member 361 on which a heat generation unit is disposed is in contact with an inside of the endless belt 363, and the heating member 361 is urged towards the press roller 366, whereby a fixing nip having a predetermined width is formed between the heating member 361 and the press roller 366. Since the heating member 361 applies heat while forming a nip region, the sheet passing through the nip can be heated more quickly than a heating system using a halogen lamp.

For example, the endless belt 363 is obtained by forming a silicone rubber layer having a thickness of 200 μm on an outside a layer formed of a SUS base material having a thickness of 50 μm or heating-resistant resin (e.g., polyimide) having a thickness of 70 μm, and by coating the outermost periphery with a surface protecting layer such as PFA. The press roller 366 includes, for example, a silicone sponge layer having a thickness of 5 mm formed on a surface of an iron rod having ϕ10 mm, and the outermost periphery is coated with the surface protecting layer such as PFA.

Furthermore, the heating member 361 is obtained by stacking a glaze layer and a heating-resistant layer on a ceramic base layer. In order to prevent warpage of the ceramic base layer while conducting excessive heat on the other side, the heating-resistant layer is, for example, formed of a known material such as $TaSiO_2$ and is divided into parts of predetermined lengths and predetermined numbers in the main scanning direction (i.e., a width direction of the endless belt 363).

A method of forming the heating-resistant layer is similar to a known method (for example, a method of creating a thermal head), and an aluminum or masking layer is formed on the heating-resistant layer. The aluminum layer is formed in a pattern in which a portion between adjacent heat generating members is insulated, and a heat generation resistor (heat generating member) is exposed in a sheet conveying direction. Electric conduction to a heating-resistant layer is achieved by providing wiring from aluminum layers (electrodes) of both ends and connecting each wiring to the switching element of a switching driver IC. Furthermore, a protective layer is formed on the upper limit portion to cover an entirety of the heating-resistant layer, the aluminum layer, the wiring, and the like. For example, the protective layer is formed of $Si_3N_4$ and the like.

Figure 5:
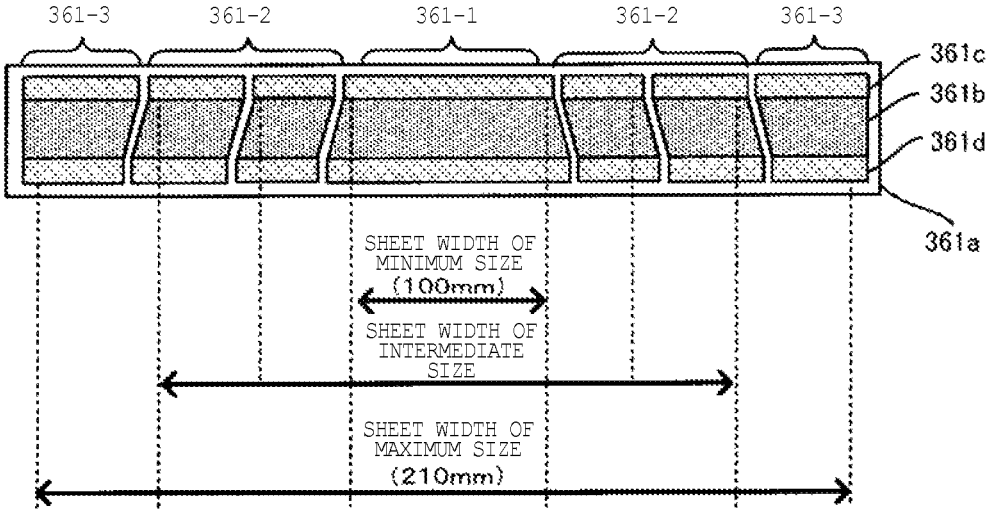
FIG. 5 illustrates a layout of a heat generating member group of the fixing device according to the embodiment.

FIG. 5 illustrates a layout of a heat generating member group according to the present embodiment. As illustrated in FIG. 5, a plurality of heat generating members 361*b* having various lengths in right and left directions in FIG. 5 and formed in a parallelogram or a trapezoidal shape are arranged in parallel. Further, an electrode 361*c* and an electrode 361*d* are formed in both ends each of the heat generating members 361*b* in the sheet transport direction (up and down directions in FIG. 5).

As illustrated in FIG. 5, each of the heat generating members 361*b* is driven by a DC or AC voltage. However, for example, in a case of an AC high voltage (100 V or more) or in a case of large current with a DC voltage, it is necessary to sufficiently ensure a creepage distance or a space distance between adjacent heat generating members 361*b* for safety measures. The creepage distance is the shortest distance between two conductive portions along the surface of the insulator. On the other hand, the space distance is the shortest distance between two conductive portions through a space. When those distances are excessively long, it may cause temperature drop at a boundary portion.

In the embodiment, the shape of each heat generating member 361*b* is designed to prevent temperature non-uniformity at the boundary of the heat generating members while maintaining the creepage distance or the space distance at the boundary. Specifically, in FIG. 5, each of the heat generating member 361*b* is formed in the parallelogram or the trapezoidal shape. The electrode 361*c* and the electrode 361*d* are respectively formed on an upper side and a lower side thereof. Thus, a side surface positioned at the boundary between adjacent heat generating members 361*b* is inclined at a predetermined angle with respect to the sheet transport direction, and the facing side surfaces are parallel to each other. Thus, it is possible to decrease temperature non-uniformity at the boundary of adjacent heat generating members 361*b* without changing the creepage distance.

Furthermore, as illustrated in FIG. 5, in the present embodiment the heating member 361 includes the heat generating members 361*b* having the plurality of types of lengths where the length in right and left directions in FIG. 5 corresponds to the size of the sheet. Specifically, the heating member 361 is divided into the heat generating members (heat generation elements) 361*a* having the plurality of types of lengths corresponding to a postcard size (100×148 mm), a CD jacket size (121×121 mm), a B5R size (182×257 mm), and an A4R size (210×297 mm). The heat generating member group is arranged, such that the heated region is approximately 5% or approximately 10 mm larger than the size of the sheet, taking into account transport accuracy, skew of the transported sheet, and escape of heat to a non-heating portion.

For example, in order to correspond to a width of 100 mm of a postcard size, which is the minimum size, a first heat generating member group 361-1 is provided at a center portion in the main scanning direction (right and left directions in FIG. 5) and a width thereof is 105 mm. Next, in order to correspond to large sizes of 121 mm and 148 mm, a second heat generating member group 361-2 having a width of 50 mm is arranged on an outside (right and left directions in FIG. 5) of the first heat generating member group 361-1 and covers a width of up to 155 mm (obtained by 148 mm with plus 5%). Furthermore, in order to correspond to large sizes of 182 mm and 210 mm, a third heat generating member group 361-3 having a width of each heat generating member being 65 mm is provided on a further outside of the second heat generating member group 361-2 and covers a width of up to 220 mm that is obtained by 210 mm with plus 5%. In addition, the number of divisions of the heat generating member groups and each width thereof are an example, and the disclosure is not limited to the example. For example, when the MFP 10 corresponds to five medium sizes, the heat generating member group may be divided into five according to the size of each medium.

Furthermore, in the present embodiment, a line sensor (not illustrated) is arranged in the sheet passing region, and it is possible to determine the size and the position of the passing sheet in real time. Alternatively, the sheet size may be determined based on the image data when starting the print operation or information of the sheet feeding cassette 18 in which the sheets within the MFP 10 are stored.

Figure 6A:
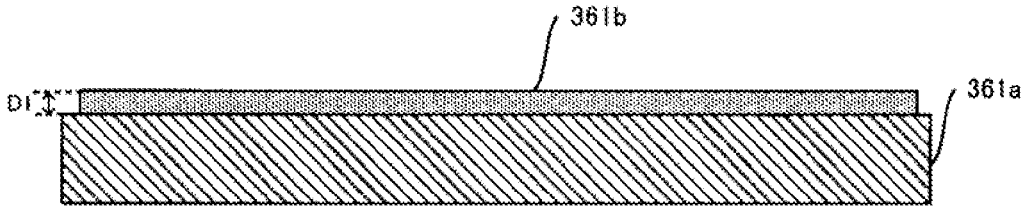
FIGS. 6A to 6C are cross-sectional views of the heat generating member(s) to describe a creepage distance between adjacent heat generating members.
Figure 6B:
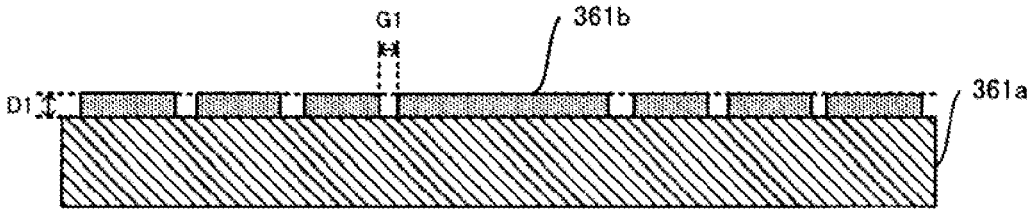
Figure 6C:
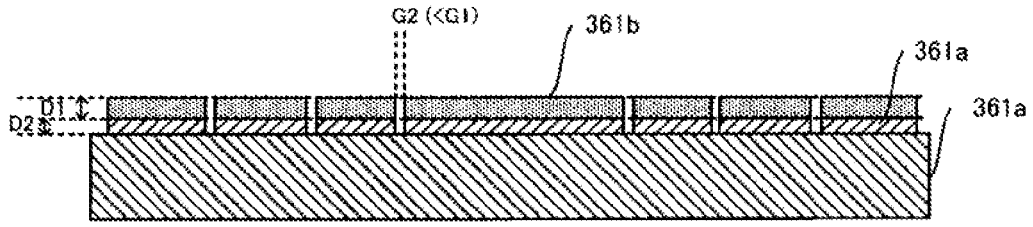

FIGS. 6A to 6C are cross-sectional views of the heat generating members 361*b* illustrating the creepage distance between the heat generating members 361*b*. FIG. 6A is a cross-sectional view of the heat generating member 361*b* in a longitudinal direction thereof that is not divided. Here, a single heat generating member 361*b* having a thickness D1 is fixed on the ceramic substrate 361*a*, which is the insulating layer. FIG. 6B illustrates a plurality of heat generating members 361*b* that have the thickness D1. Similar to FIG. 6A, the heat generating members 361*b* (heat generation layer) are fixed on the ceramic substrate 361*a*. Since the heat generating members 361*b* (heat generation layer) are a conductor, D1 does not affect the creepage distance. Since the boundary portion is insulated, when the space distance between adjacent heat generating members 361*b* is G1, the creepage distance is also G1. FIG. 6C illustrates a plurality of heating members 361*b* according to the present embodiment. The thickness of the heat generating members 361*b* (heat generation layer) is D1 similar to FIGS. 6A and 6B. However, besides the ceramic substrate 361*a*, a block-shaped ceramic substrate 361*a*' is provided below the heat generating members 361*b* as a separate insulating layer. An upper surface of the ceramic substrate 361*a*' has the same shape as the lower surfaces of the heat generating members 361*b*. The space distance between adjacent heat generating members 361*b* is G2, which is shorter than G1 and the creepage distance is 2×D2+G2 by separately providing the ceramic substrate 361*a*' having a thickness of D2. That is, temperature drop is suppressed in the boundary portion, and safety measures are performed simultaneously by adjusting the creepage distance to be sufficiently long even though the space distance is short.

Figure 7:
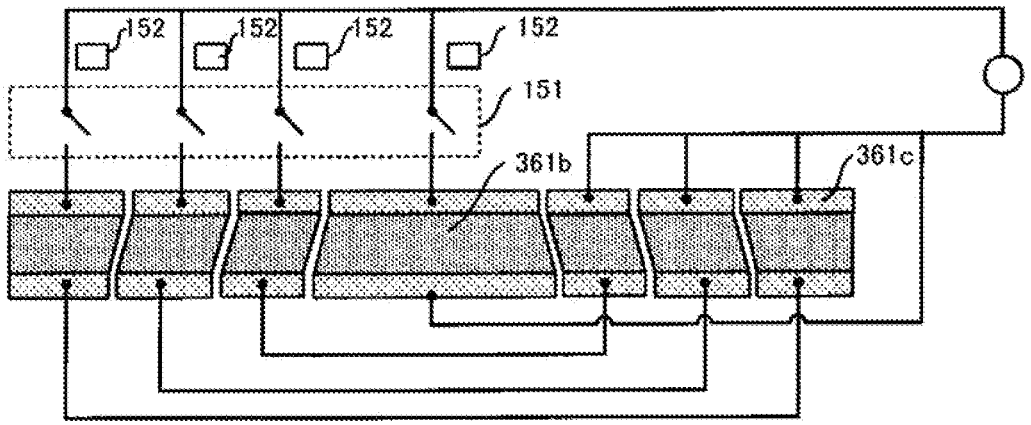
FIG. 7 illustrates a connection state between the heat generating member group and a driving circuit of the fixing device according to the embodiment.

FIG. 7 illustrates a connection state between the heat generating member group and a driving circuit thereof. As illustrated in FIG. 7, electric conduction of the heat generating member 361*b* is controlled individually or by each group in symmetrical positions with respect to the center portion by a corresponding driving IC 151. The heat generating members 361*b* are entirely connected respectively in parallel such that the same potential is applied. A pair of the heat generating members 361*b* that are in symmetrical positions with respect to the center portion are connected in series in a parallel circuit and driving thereof is controlled by the same driving IC 151. Since the number of the driving ICs 151 may be smaller than the number of the heat generating members 361*b*, the number of the driving ICs 151 can be reduced and it is possible to suppress the device size and manufacturing cost.

The driving IC 151 is a switching unit of electric conduction with respect to each heat generating member 361*b*, and includes, for example, a switching element, an FET, a triax, a switching IC, and the like. In FIG. 7, the voltage is applied to each heat generating member 361*b* with an alternating current to generate heat, but a direct current may be used.

For example, when the sheet P is the minimum size (e.g., postcard size), only the driving IC 151 of the heat generating member group 361-1 (first heat generating member group) arranged at the center (FIG. 5) is turned ON to generate heat. As the size of the sheet P becomes large, the driving IC 151 of the second heat generating member group 361-2 (FIG. 5) and the third heat generating member group 361-3 (FIG. 5) are controlled to be sequentially turned ON. Electric resistance is adjusted such that the first to third heat generating member groups 361-1, 361-2, 361-3 have uniform temperature rising rate.

Furthermore, in FIG. 7, since the current supplied from the power supply flows by being divided into four, similar to the driving IC 151, a safety element 152 is provided in each parallel circuit. The safety element 152 is an element for blocking the electric circuit by controlling the driving IC 151 when a temperature detection result of the temperature detecting member 362 (not illustrated) measuring the surface temperature of the corresponding heat generating member 361*b* is "abnormal temperature detection".

Figure 8:
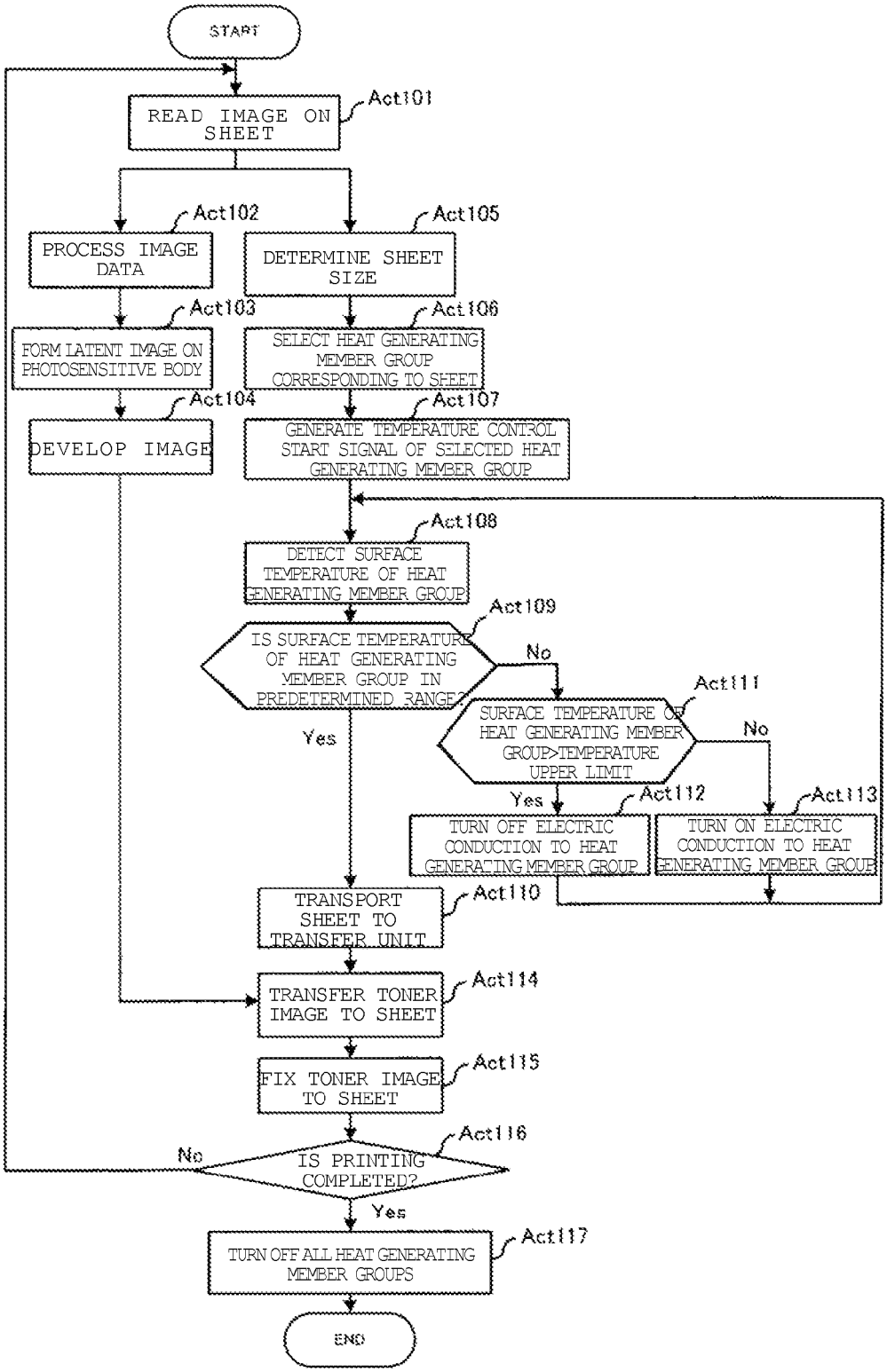
FIG. 8 is a flowchart of a control operation carried out by the image forming apparatus.

Hereinafter, a printing operation performed by the MFP 10 configured as described above will be described with reference to FIG. 8. FIG. 8 is a flowchart of the printing operation performed by the MFP 10 according to the present embodiment.

First, when the image data is read by the scanner unit 15 (Act101), an image forming control program to control the image forming unit 20 and a fixing temperature control program to control the fixing device 36 are executed in parallel.

When the image forming is started, the read image data is processed (Act102), the electrostatic latent image is formed on the surface of the photosensitive drum 22 (Act103), the electrostatic latent image is developed by the developer 24 (Act104), and then the process proceeds to Act114.

When the fixing temperature controlling is started, for example, the sheet size is determined based on a detection signal of a line sensor (not illustrated) and sheet selection information by the operation unit 14 (Act105). Then, the heat generating member group arranged in the position (sheet passing region) through which the sheet P passes is selected as a heat generation object (Act106).

Next, when a temperature control start signal to the selected heat generating member group is generated (Act107), the electric conduction is performed to the selected heat generating member group, and a surface temperature of the heat generating member group increases. That is, when the heating region is determined, all selected heat generating members 361*b* are actuated by the same control. In this case, the heat generating members 361*b* which are electrically conducted generate heat at a uniform temperature rising rate.

Next, when the surface temperature of the heat generating member group is detected by a temperature detecting member (not illustrated) arranged on the inside or the outside of the endless belt 363 (Act108), it is determined whether or not the surface temperature of the heat generating member group is in a predetermined temperature range (Act109). Here, when it is determined that the surface temperature of the heat generating member group is in the predetermined temperature range (Act109: Yes), the process proceeds to Act110. On the other hand, when it is determined that the surface temperature of the heat generating member group is not in the predetermined temperature range (Act109: No), the process proceeds to Act111.

In Act 111, it is determined whether or not the surface temperature of the heat generating member group exceeds a predetermined upper limit value. Here, when it is determined that the surface temperature of the heat generating member group exceeds the predetermined upper limit value (Act111: Yes), the electric conduction to the heat generating member group selected in Act106 is turned OFF (Act112) and the process returns to Act108. On the other hand, when it is determined that the surface temperature of the heat generating member group does not exceed the predetermined upper limit value (Act111: No), since the surface temperature is less than the predetermined lower limit value according to a determination result of Act109, the electric conduction to the heat generating member group is maintained to be in an ON state or turned ON again (Act113), and the process returns to Act108.

Next, in a state where the surface temperature of the heat generating member group is in the predetermined temperature range, the sheet P is transported to a transfer unit (Act110), and then the toner image is transferred to the sheet P (Act114). Thereafter, the sheet P is transported towards the fixing device 36.

Next, when the toner image is fixed in the sheet P within the fixing device 36 (Act115), it is determined whether or not the printing of the image data is completed (Act116). Here, when it is determined that the printing is completed (Act116: Yes), the electric conduction to all the heat generating member groups is turned OFF (Act117) and the process is completed. On the other hand, when it is determined that the printing of the image data is not completed (Act116: No), that is, when the image data of the printing object remains, the process returns to Act101 and the same process is repeated until the process is completed.

As described above, according to the present embodiment, it is possible to not only prevent abnormal heat generation of a non-sheet passing portion of the heat generating member, but also suppress wasteful heating of the non-sheet passing portion of the heat generating member by switching the heat generating member group based on a group to which the sheet size to be used belongs. Thus, it is possible to significantly reduce thermal energy consumed by the fixing device 36. Furthermore, the shape or the layer structure of the heat generating members 361 are designed without changing the creepage distance between the electrodes formed in both ends and the creepage distance or the space distance in the boundary portion between adjacent heat generating members 361*b*. Thus, temperature drop is suppressed in the boundary portion and safety measures may be performed simultaneously. As a result, temperature non-uniformity of the heating member 361 is absent in the boundary portion, and it is possible to improve fixing quality.

Modification Example

Hereinafter, some modification examples of the embodiment described above will be described with reference to FIGS. 9-11 in detail.

Figure 9:
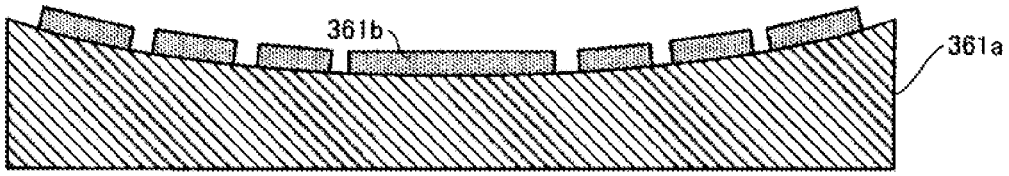
FIG. 9 is a cross-sectional view of the heat generating member and a ceramic base layer according to a modification example of the embodiment.

FIG. 9 is a cross-sectional view of the heat generating member 361*b* and the ceramic substrate 361*a* according to a modification example of the above embodiment. Here, the upper surface of the ceramic substrate 361*a* to which the plurality of heat generating members 361*b* is fixed is formed in a curved shape without changing the creepage distance. An angle of the curve in the upper surface is determined so as not to reduce the space distance excessively. As illustrated in FIG. 9, the plurality of heat generating members 361*b* is fixed on a curved surface of the ceramic substrate 361*a* having a crown shape. Thus, the space distance in the boundary portion between adjacent heat generating members 361*b* is shorter than the creepage distance. Each heat generating member 361*b*, which is independently patterned, may be adhered on the ceramic substrate 361*a* or, as described above, patterned after a single resistance heat generation layer is formed on the ceramic substrate 361*a*.

Figure 10:
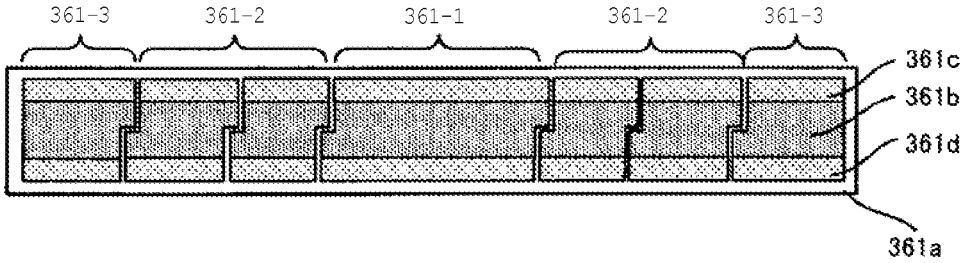
FIG. 10 is a plan view of a heat generating member group according to another modification example of the embodiment.
Figure 11:
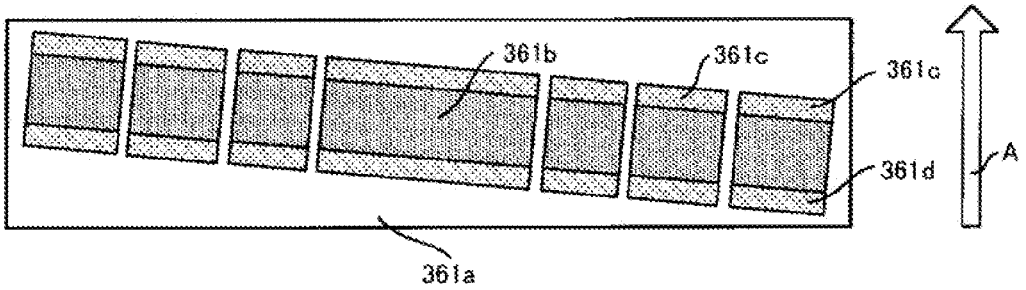
FIG. 11 is a plan view of the heat generating member group according to still another modification example of the embodiment.

FIGS. 10 and 11 illustrate another shape pattern of a heat generating member group according to other modification examples of the above embodiment. FIG. 10 illustrates that the creepage distance between the electrode 361*c* and the electrode 361*d* is maintained, but the boundary portion between adjacent heat generating members 361*b* is in a jagged or zig-zag shape and the facing surfaces in the boundary portion are only locally parallel to each other.

Furthermore, when the sheets of different size are transported and printed during continuous printing (particularly, when a sheet of a smaller size is initially printed and then a sheet of a larger size is printed), in order to ensure a time until a temperature detection result of the temperature detecting members 362 becomes the same, it is preferable that transport intervals of the sheets are extended or a transport speed is slowed down.

Furthermore, it is preferable that the length of the heat generating members 361*b* is adjusted such that the boundary portion is the outside of the end portion of the sheet passing region, because it is possible to suppress the influence of the boundary portion.

Furthermore, in the embodiment described above, a the size of the sheet passing region of the sheet P is determined based on sheet setting information before the sheet P reaches the fixing device 36. Alternatively, it is also possible to determine and heat the position through which a printing region (image forming region) is going to pass instead of the sheet passing region of the sheet. A method of determining the size of the printing region of the sheet P includes a method of using an analysis result of image data, a method based on print format information such as margin setting of the sheet P, a method of determining based on a detection result of an optical sensor, and the like. In this case, since only a portion to be fixed may be limitedly heated, it is possible to further increase energy saving efficiency.

FIG. 11 illustrates a rectangular heat generating members 361*b* that are fixed on the ceramic substrate 361*a* and inclined at a certain angle with respect to the sheet transport direction indicated by arrow A. As illustrated in FIG. 5 described above, when the heat generating member 361*b* is formed in the parallelogram or the trapezoidal shape, since the current flows through a path of the shortest distance within the member, temperature difference may be generated in the same heat generating member 361*b* depending on the size of the heat generating member 361*b*. In contrast, in FIG. 11, it is possible to make electric conduction conditions and heat generation conditions uniform by disposing the rectangular heat generating members 361*b* of which the distances between the electrode 361*c* and the electrode 361*d* are the same so that the heat generating members 361*b* are inclined with respect to the sheet transport direction.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device, comprising:

a roller;

an endless belt having a portion facing the roller; and a heat generating member disposed such that the portion of the endless belt is between the heat generating member and the roller, the heat generating member extending in a width direction of the endless belt and pressing the portion of the endless belt against the roller such that a sheet can be passed in a sheet conveying direction through a nip formed between the roller and the portion of the endless belt and an image on the sheet can be fixed thereto, wherein the heat generating member includes first, second, and third heat generating portions that are separated from each other and arranged along the width direction, and the first heat generating portion is independently operable with respect to the second and third heat generating portions, the second and third heat generating portions are arranged symmetrically with respect to the first heat generating portion in the width direction, and a boundary between the first and second heat generating portions includes at least a portion extending in a direction that crosses the sheet conveying direction.

2. The fixing device according to claim 1, wherein the heat generating member includes a base insulating layer on which the first, second, and third heat generating portions are formed, and each of the first, second, and third heat generating portions includes a first electrode, a second electrode, and a heat generating layer electrically connected between the first and second electrodes.

3. The fixing device according to claim 2, wherein the heat generating member further includes an intermediate insulating layer having a first portion between the base insulating layer and the first heat generating portion and a second portion between the base insulating layer and the second heat generating portion, the first portion of the intermediate insulating layer having the same shape as the first heat generating portion and the second portion of the intermediate insulating layer having the same shape as the second heat generating portion.

4. The fixing device according to claim 2, wherein a surface of the base insulating layer on which the first, second, and third heat generating portions are formed is a curved surface, and a distance between the surface of the base insulating layer and the endless belt is greater at a central portion of the surface than at an end portion of the surface.

5. The fixing device according to claim 1, wherein the portion of the boundary extends in a direction perpendicular to the sheet conveyance direction.

6. The fixing device according to claim 1, wherein the boundary between first and second heat generating portions is inclined with respect to the width direction.

7. The fixing device according to claim 1, wherein the first heat generating portion has substantially a trapezoidal shape, and the second heat generating portion has substantially a shape of a parallelogram.

8. The fixing device according to claim 1, wherein the second and third heat generating portions are connected in series and operated collectively, and the first heat generating portion and the serial connection of the second and third heat generating portions are connected in parallel.

9. An image forming apparatus, comprising:

an image forming unit configured to form an image on a sheet; and a fixing unit configured to fix the image to the sheet and including:

a roller;

an endless belt having a portion facing the roller; and a heat generating member disposed such that the portion of the endless belt is between the heat generating member and the roller, the heat generating member extending in a width direction of the endless belt and pressing the portion of the endless belt against the roller such that the sheet can be passed in a sheet conveying direction through a nip formed between the roller and the portion of the endless belt pressed by the heat generating member and an image on the sheet can be fixed thereto, wherein the heat generating member includes first, second, and third heat generating portions that are separated from each other along the width direction, and the first heat generating portion is independently operable with respect to the second and third heat generating portions, the second and third heat generating portions are arranged symmetrically with respect to the first heat generating portion in the width direction, and a boundary between the first and second heat generating portions includes at least a portion extending in a direction that crosses the sheet conveying direction.

10. The image forming apparatus according to claim 9, further comprising:

a controller configured to control the heat generating member according to a size of the sheet such that when the size is determined to be a first size, the first heat generating portion generates heat and the second heat generating portion does not generate heat, and when the size is determined to be a second size that is greater than the first size, the first, second, and third heat generating portions generate heat.

11. The image forming apparatus according to claim 10, wherein when the size is determined to be the first size, the sheet is passed through a first region of the nip corresponding to the first heat generating portion, the first region not including those portions of the nip corresponding to the second and third heat generating portions, and when the size is determined to be the second size, the sheet is passed through a second region of the nip corresponding to the first, second, and third heat generating portions.

12. The image forming apparatus according to claim 9, wherein the heat generating member includes a base insulating layer on which the first, second, and third heat generating portions are formed, and each of the first, second, and third heat generating portions includes a first electrode, a second electrode, and a heat generating layer electrically connected between the first and second electrodes.

13. The image forming apparatus according to claim 12, wherein the heat generating member further includes an intermediate insulating layer having a first portion between the base insulating layer and the first heat generating portion and a second portion between base insulating layer and the second heat generating portion, the first portion of the intermediate insulating layer having the same shape as the first heat generating portion and the second portion of the intermediate insulating layer having the same shape as the second heat generating portion.

14. The image forming apparatus according to claim 12, wherein a surface of the base insulating layer on which the first, second, and third heat generating portions are formed is a curved surface, and a distance between the surface of the base insulating layer and the endless belt is greater at a central portion of the surface than at an end portion of the surface.

15. The image forming apparatus according to claim 9, wherein the portion of the boundary extends in a direction perpendicular to the sheet conveyance direction.

16. The image forming apparatus according to claim 9, wherein the boundary between first and second heat generating portions is inclined with respect to the width direction.

17. The image forming apparatus according to claim 9, wherein the first heat generating portion has substantially a trapezoidal shape, and the second heat generating portion has substantially a shape of a parallelogram.

18. The image forming apparatus according to claim 9, wherein the second and third heat generating portions are connected in series and operated collectively, and the first heat generating portion and the serial connection of the second and third heat generating portions are connected in parallel.

19. A fixing device, comprising:

a roller;

an endless belt having a portion facing the roller; and a heat generating member disposed such that the portion of the endless belt is between the heat generating member and the roller, the heat generating member extending in a width direction of the endless belt and pressing the portion of the endless belt against the roller such that a sheet can be passed in a sheet conveying direction through a nip formed between the roller and the portion of the endless belt and an image on the sheet can be fixed thereto, wherein the heat generating member includes first, second, and third heat generating portions that are adjacent to each other in the width direction, and the first heat generating portion is independently operable with respect to the second and third heat generating portions, and the second and third heat generating portions are arranged symmetrically with respect to the first heat generating portion in the width direction, and a boundary between the first and second heat generating portions includes a first boundary portion that extends along the sheet conveying direction and a second boundary portion that extends along the width direction or a direction inclined with respect to the sheet conveying direction.

20. The fixing device according to claim 19, wherein the heat generating member includes a base insulating layer on which the first, second, and third heat generating portions are formed, each of the first, second, and third heat generating portions includes a first electrode, a second electrode, and a heat generating layer electrically connected between the first and second electrodes, and the second boundary portion is between the heat generating layer of the first heat generating portion and the heat generating layer of the second heat generating portion.

* * * * *